US006394013B1

(12) United States Patent
Engle

(10) Patent No.: US 6,394,013 B1
(45) Date of Patent: May 28, 2002

(54) METHOD AND APPARATUS FOR SEWING A FRINGE TO A WOVEN FABRIC MATERIAL

(75) Inventor: Elbert E. Engle, Steele, AL (US)

(73) Assignee: XYZ Control, Inc., Steele, AL (US)

( * ) Notice: Subject to any disclaimer, the term of this patent is extended or adjusted under 35 U.S.C. 154(b) by 0 days.

(21) Appl. No.: 09/549,956

(22) Filed: Apr. 14, 2000

(51) Int. Cl.[7] ..... D05B 65/06
(52) U.S. Cl. ..... 112/289; 112/294; 112/301
(58) Field of Search ..... 112/129, 130, 112/285, 287, 289, 294, 297, 301, 64; 139/383, 303

(56) References Cited

U.S. PATENT DOCUMENTS 3,698,447 A * 10/1972 Guerin ..... 139/303
3,924,554 A * 12/1975 Cummins ..... 112/287

* cited by examiner

*Primary Examiner*—Peter Nerbun
(74) *Attorney, Agent, or Firm*—Robert J. Veal; Brendan E. Squire; Burr & Forman LLP

(57) ABSTRACT

A method and apparatus for sewing a fringe to a woven textile work piece. A method and apparatus for cutting a uniform fringe edge on woven textile material fringe. A method and apparatus for severing a woven textile work piece from a sewing machine.

6 Claims, 9 Drawing Sheets

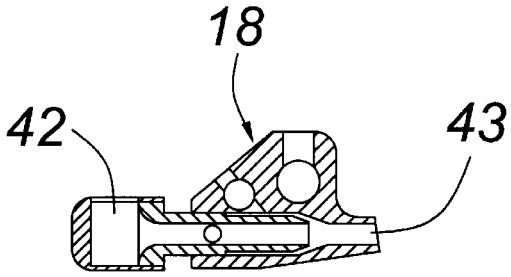
FIG. 7
FIG. 8
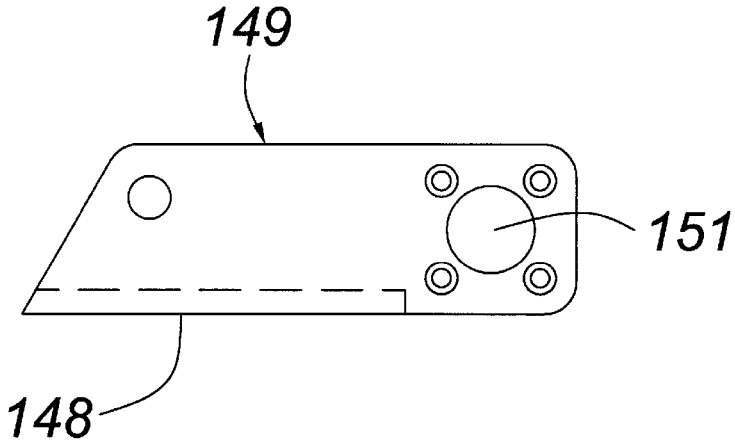
FIG. 9
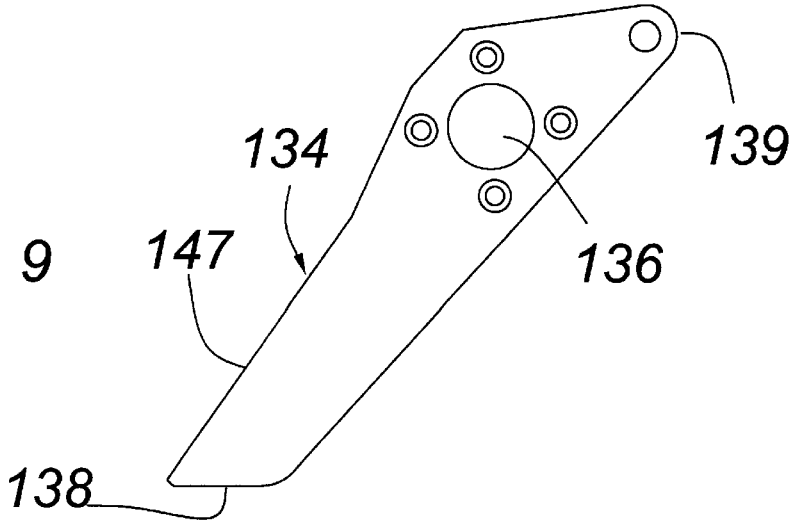

METHOD AND APPARATUS FOR SEWING A FRINGE TO A WOVEN FABRIC MATERIAL

FIELD OF THE INVENTION

The present invention relates to a method and apparatus for sewing a fringe woven material fabric. The present invention further relates to a method and apparatus for trimming a fringe to obtain a uniform fringe length. The invention further relates to a method and apparatus for cutting the finished material from the fringe sewing apparatus.

BACKGROUND OF THE INVENTION

For many years the process of applying a fringe to woven textile materials has relied upon either weaving the fringe as the textile material is produced, or applying fringe belts to the textile material as a finishing step in the process. Furthermore, the many processes for producing woven textile materials necessitates a reliable means for trimming the woven fringe ends to uniform finished lengths.

In fringe application processes, is often desirable to have a single fringe yarn source to improve the efficiency and reliability of the fringing process. It is also desirable to obtain an aesthetically pleasing appearance for the finished product by severing the fringe loops. Moreover, severing the fringe loops has the added benefit of preventing the loops from catching objects and either unraveling the fringe or underlying textile material. Severing the fringe loops in carpet and apparel applications may also prevent personal injuries as the carpet fringe loops could catch a heel or a garment fringe loop could catch an extended object.

In sewing machine processes, the work is often performed by manual labor. The ability to quickly, safely and reliably sever the finished work piece from the sewing machine improves the efficiency of the operation.

SUMMARY OF THE INVENTION

It is the object of the present invention to provide a method and apparatus for applying a fringe to a woven textile material during production or post production processes without the need for applying fringe belts or altering the weaving loom to obtain a finished fringe edge.

Another object of the present invention is to provide a method and apparatus for obtaining a fringe on a woven textile material utilizing a single fringe yarn creel, thereby eliminating problems associated with multiple yarn feeding systems.

The present invention also provides a method and apparatus for obtaining a uniform trimmed fringe length for woven textile materials.

The present invention also provides a method and apparatus for quickly severing a finished work piece from a sewing machine.

BRIEF DESCRIPTION OF THE DRAWINGS

Apparatus embodying features of my invention are depicted in the accompanying drawings, which form a portion of this disclosure wherein:

FIG. 7 is a sectional view of the fringe insertion jet.

FIG. 8 is a frontal view of the upper blade member.

FIG. 9 is a frontal view of the lower blade member.

DESCRIPTION OF THE PREFERRED EMBODIMENT

Figure 1:
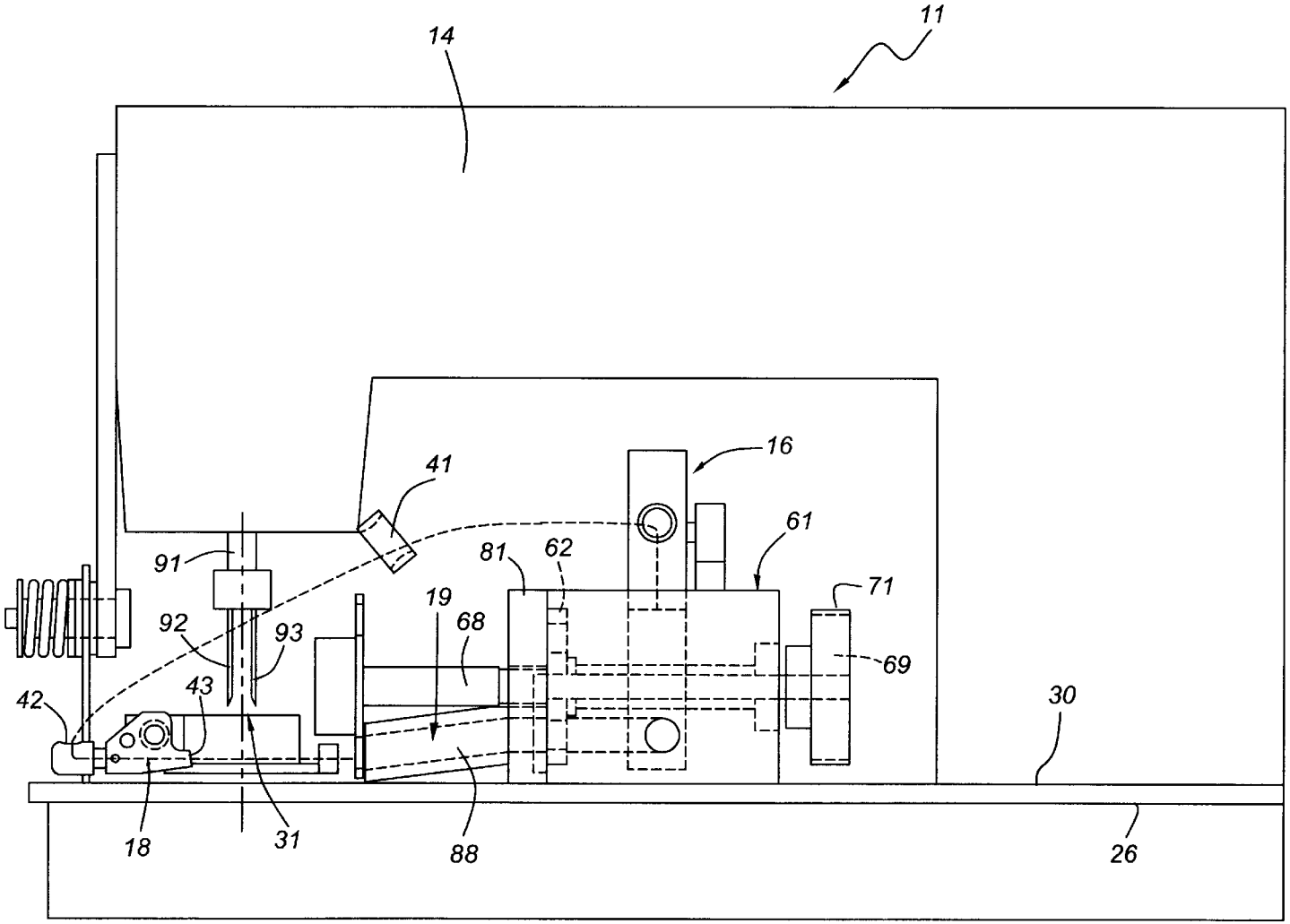
FIG. 1 is a frontal view of the sewing machine and fringe sewing apparatus.

Referring to the drawings for a clearer understanding of the invention, it may be seen that FIG. 1 shows a fringe sewing apparatus 11 for forming and attaching a fringe edge 12 to woven textile material. A standard, commercial, two-needle sewing machine 14 is partially incorporated into and adapted to accept the fringe sewing apparatus 11, which includes a fringe yarn puller and measuring gauge 16, a fringe yarn insertion jet 18, a fringe yarn tensioner 19, a fringe cutter 21, and a work piece side cutter 22. In the present embodiment, a fringe yarn creel 23 and a fringe yarn knot detector 24 are shown mounted independently of the apparatus. The apparatus further utilizes a table 26, which supports the fringe sewing apparatus 11 and provides a work surface 30 on which to manipulate the woven textile material into the sewing needles 31.

Figure 2:
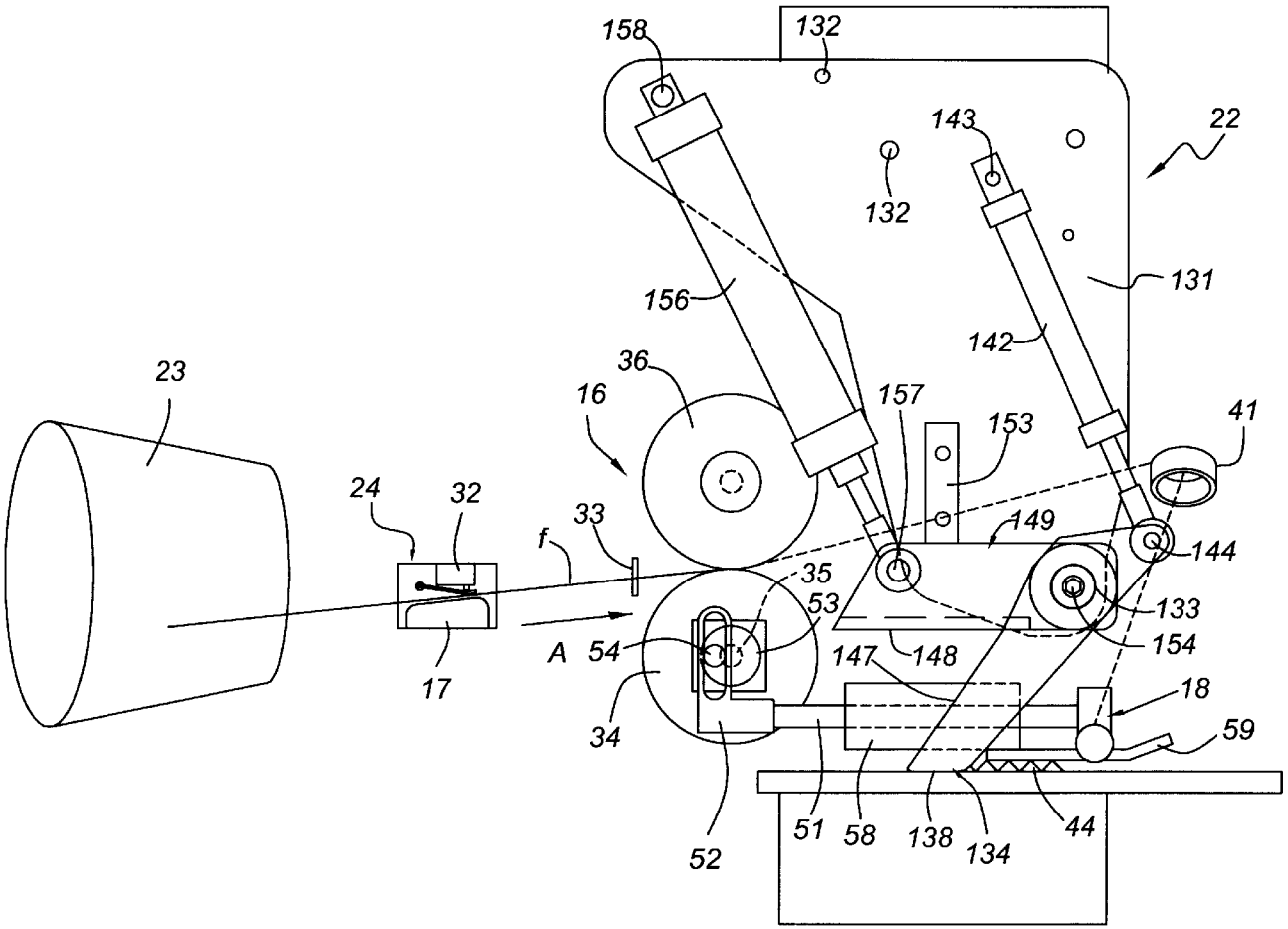
FIG. 2 is a side view of the sewing machine and fringe sewing apparatus.
Figure 3:
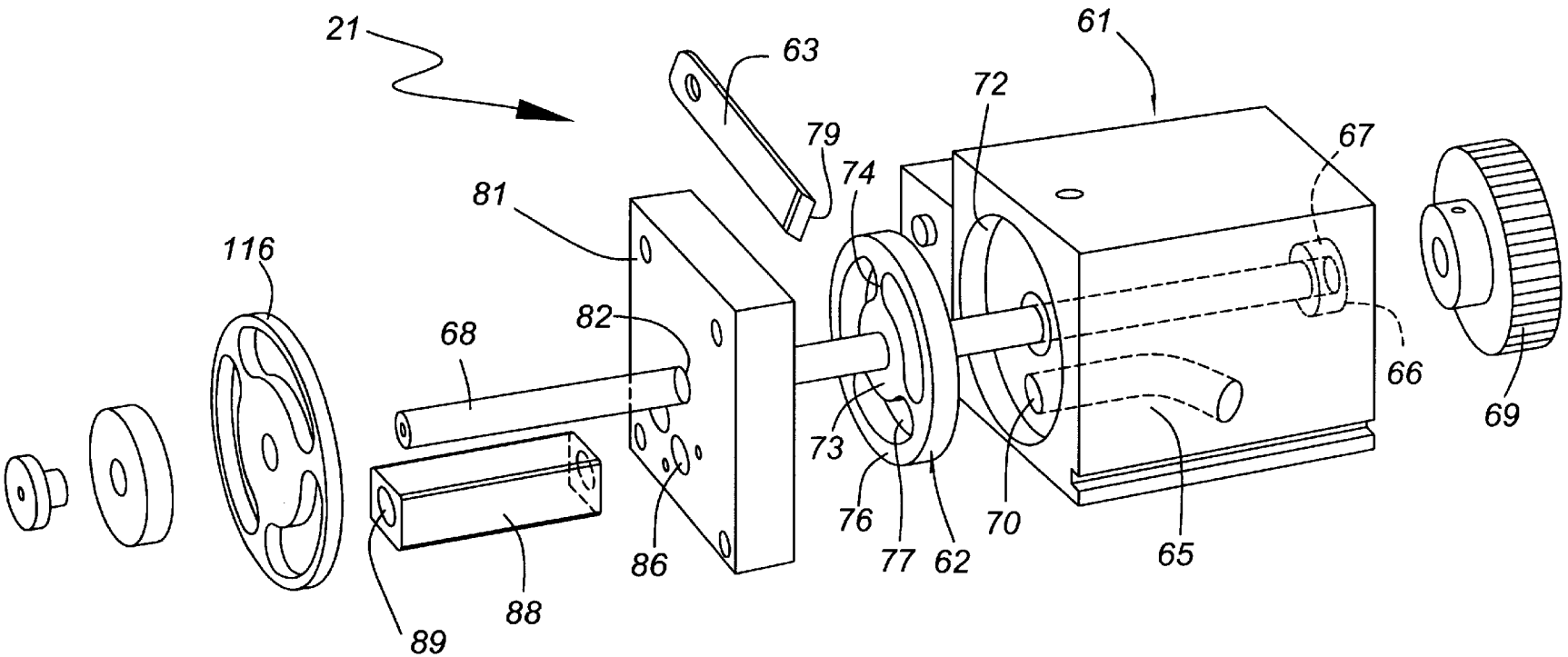
FIG. 3 is an exploded view of the fringe loop cutter.
Figure 5:
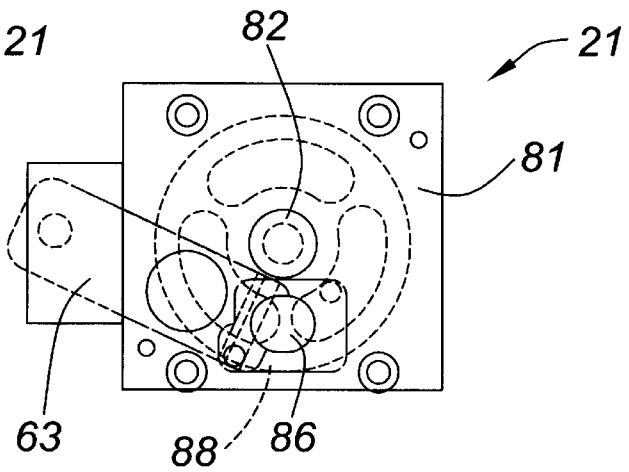
FIG. 5 is an end view of the fringe loop cutter with the enclosure plate attached.
Figure 4:
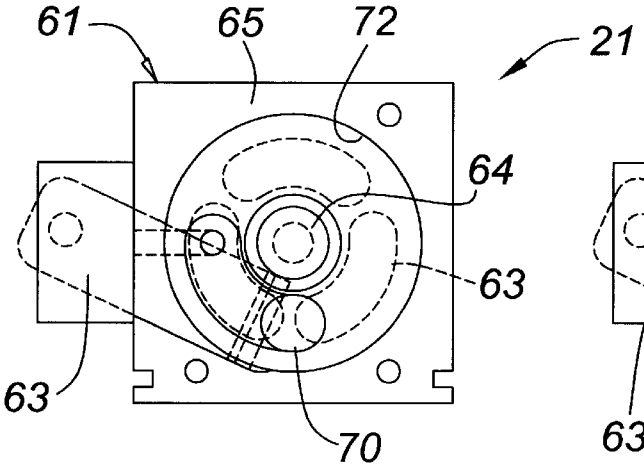
FIG. 4 is an end view of the fringe loop with the enclosure plate removed.
Figure 6:
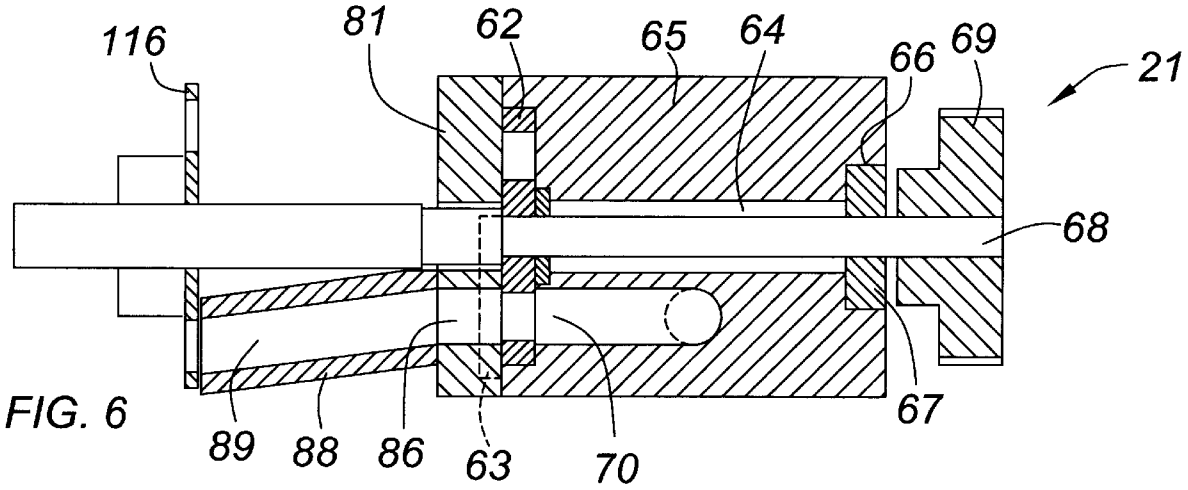
FIG. 6 is a sectional view of the fringe loop cutter.

Referring to FIG. 2, the combined yarn puller and measuring gauge 16 draws the fringe yarn f from the yarn creel 23 and through a knot detector 24. Knot detector 24 has a guide for routing the fringe yarn f through the detector 24 and a micro switch 32 which interrupts the process should a knot be encountered. The fringe yarn f is routed into the yarn puller 16, which is mounted behind the sewing machine 14 and attached to the table surface, through a guide 33 where it is drawn between a friction roller 34 and an idler roller 36. The friction roller 34 is driven by a drive shaft 35 operatively connected and synchronized by drive belts (not shown) and drive gears (not shown) to the sewing machine main drive shaft (not shown). The idler roller 36 is biased by gravity and a spring against the friction roller 34 to pinch the fringe yarn f against the surface of friction roller 34, the fringe yarn f being drawn from the yarn creel 23 by the rotation of friction roller 34. The friction roller diameter is selected to draw a predetermined length of fringe yarn corresponding with the desired finished fringe length based on the rotation of the roller 34.

The fringe yarn f is then routed to the front of the machine to a forward fringe yarn guide 41 mounted to the apparatus. From forward fringe yarn guide 41, the fringe yarn f is routed into the fringe yarn intake port 42 of the venturi insertion jet 18. The fringe yarn f is drawn by vacuum through the venturi jet 18 and is projected through an outlet port 43 substantially parallel to the work surface 30 of table 26 and normal the feed path indicated by arrow A of the material work piece 13 as it fed into the sewing needles 31 by sewing machine feed dogs 44 during the fringing cycle described below. Outlet port 43 is positioned such that fringe yarn f is projected upstream sewing needles 31 across the work piece feed path.

In FIGS. 1,2, 7, and 10–13, the venturi jet 18 is mounted to the fringe sewing apparatus 11 such that it reciprocates in a path parallel the feed path and normal the reciprocating sewing machine needles 31. The reciprocation of the jet 18 is synchronized with the sewing needles 31 such that the jet 18 completes one cycle every two needle cycles. The venturi insertion jet is attached to the end of a shaft 51, which extends rearwardly and is fixed to a slotted L shaped eccentric arm 52. The eccentric arm 52 is attached to a rotating cylinder 53 by means of a screw or pin 54 eccentrically received within the cylinder 53, and slidingly engaged in the slot 56 of the L shaped eccentric arm 52. The cylinder 53 is :attached to an extension 57 of the friction roller drive shaft 35 and is rotated in concomitantly therewith. The venturi shaft 51 is slidably received within a shaft guide 58. The shaft guide 58 is attached to the press foot 59, which acts as a skid plate, supporting venturi insertion jet 18 to adjust its alignment relative the work piece surface thereby compensating for irregularities in work piece thickness. Insertion jet outlet port 43 is positioned slightly elevated from a press foot plate 59, permitting primary needle 92 to engage the fringe yarn f prior to needle penetration during the sewing cycle described below.

Referring to FIGS. 1, 3, 6, and 10–13, after projection of the fringe yarn f into the work piece feed path, the fringe yarn is captured and tensioned across the feed path by vacuum of the fringe yarn tensioner 19. In the present embodiment, the fringe yarn tensioner 19 is incorporated into an optional fringe loop cutter 21.

In FIGS. 1, 3, 4, 5, 6, and 10–13, the fringe loop cutter includes a housing 61 mounted on the front side of the sewing machine work surface 30 opposing the fringe yarn insertion jet 18, proximal the sewing needles 31. The fringe loop cutter 21 utilizes a rotary blade 62 working in sliding shearing cooperation with a fixed blade member 63. In the present embodiment the loop cutter housing 61 is formed out of an aluminum block 65. The block 65 has a central bore 64 extending through the block and first concentric bore 66 accepting a first bearing 67 therein. A blade drive shaft 68 is accepted through the central bore 64 and is journaled for sealing rotational cooperation with the bearing 67. The drive shaft 68 is operatively connected to the sewing machine drive mechanism by a drive sprocket 69 and a cog belt 71 attached to the free end of the drive shaft 68. In the present embodiment, drive shaft 68 rotates rotary blade 62 one revolution to six revolutions of the sewing machine drive shaft (not shown).

On the side opposite the drive sprocket 69, the block 65 has a recessed bore 72 of substantially larger diameter and concentric with the central bore 64, forming a recessed area for accepting the rotary blade 62 for rotation therein. The fringe yarn tensioner 19 is incorporated in the fringe loop 21 cutter utilizing a vacuum aperture 70 extending from the inner face of the recessed 72 in fluid communication with a vacuum source (not shown) attached to an outer face of the block 65, said vacuum aperture 70 and vacuum source comprising a fringe waste extractor.

The rotary blade 62 is machined out of a cylindrical steel disc. The disc has a central hub and 73 a plurality of spoke members 74 extending outwardly from hub 73, joining the hub 73 with an outer circumferential portion 76. The hub 73, spoke members 74, and outer portion 76 define a plurality of fringe acceptance chambers 77. The rotary blade 62 is attached to blade drive shaft 68 for rotation therewith. The trailing edge of each fringe acceptance chamber 77 is sharpened for cutting the fringe yarns in shearing cooperation against a sharpened edge 79 of fixed blade member 63.

Rotary blade 62 is sealed within recessed bore 72 by an enclosure plate 81 sealingly attached to block 65. The enclosure plate 81 has a central bore 82 and bearing 83 for accepting blade drive shaft 68 in sealing rotational cooperation. Enclosure plate 81 has slot 84 for accepting fixed blade member 63. A vacuum aperture 86 is located at the bottom of enclosure plate 81 in fluid communication between the inner and outer faces of enclosure plate 81. The enclosure plate vacuum aperture 86 is substantially aligned with vacuum aperture 70 in recess 72.

Fixed blade member 63 is attached to fringe cutter 21 through slot 84 in enclosure plate 81, such that sharpened fixed blade edge 79 is positioned flush against the cutting face of the rotary blade 62 at an angle relative vertical. Fixed blade 63 is adjusted such that fringe loops 87 are sheared in front of vacuum aperture 70 and drawn by vacuum therein for collection in a waste hopper (not shown) external to the sewing machine 14.

A fringe guide channel 88 is cooperatively attached and extends from the enclosure plate 81, defining a central bore 89. Central bore 89 is in fluid cooperation with enclosure plate vacuum aperture 86. Fringe guide channel 88 having a predetermined length corresponding to the desired length of the finished fringe. Fringe guide channel 88 is positioned opposing venturi insertion jet outlet port 43 and draws the fringe yarn loops through the channel 88 to fringe acceptance chambers 77.

The sewing machine needles 31 are mounted to a vertically reciprocating shaft 91 operatively connected to the sewing machine drive shaft (not shown) and drive motor (not shown). Primary sewing needle 92 is attached distal the sewing machine chassis 14. Secondary sewing needle 93 is mounted proximal the sewing machine chassis 14. Primary 92 and secondary 93 needles are separated by a predetermined distance corresponding to the width of the fringe bead 94. Primary sewing needle 92 is offset upstream of secondary needle 93 by a predetermined distance corresponding to the width of fringe yarn f. Primary 92 and secondary 93 needles are fed by independent sources of stitching thread t.

The fringe and fringe loops 87 are formed by cooperation of the reciprocating venturi insertion jet 18, the reciprocating sewing needles 31, the fringe yarn tensioner 19, and sewing machine feed dogs 44, as detailed in drawings 10, 11, 12, and 13, the fringe loops 87 are cut by the optional fringe cutter 21 after they are stitched to the work piece. Due to the speed and complexity of the fringe sewing cycle and the fact that many of the processes occur continuously throughout the cycle, the process is not clearly distinguishable into discrete cycle steps.

Figure 10:
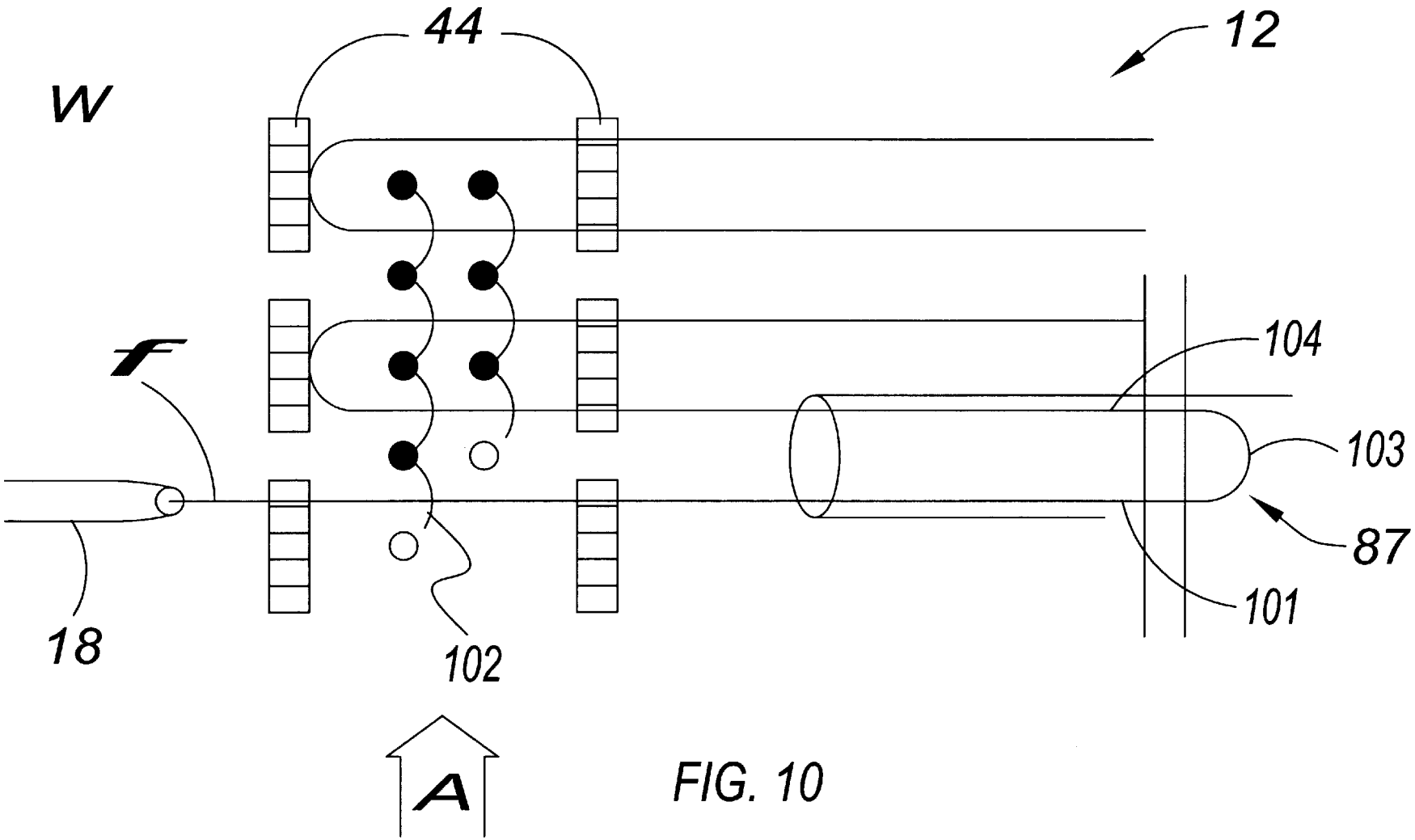
FIG. 10 depicts a schematic drawing of the first step of the fringe sewing cycle.

FIG. 10 depicts the beginning phase of the fringe sewing cycle. In the drawing the needles 31 begin in their full up position.

At the beginning of the fringe cycle, the venturi insertion jet 18 is in its full downstream position, downstream the primary needle insertion point 97. Insertion jet 18 urges previous loop trail fringe yarn 101 in abutment with the previous first stitch thread 102. The sewing needles 31 are in their full up position. Feed dogs 44 are reaching the downstream limit of their feed stroke, advancing work piece 13 thereon. Fringe yarn tensioner 19 is drawing the previous fringe loop 103 into fringe loop acceptance chamber 77.

When the cycle begins the sewing needles 31 begin their movement toward their downward positions. Venturi insertion jet 18 begins to translate upstream, projecting the final length of fringe yarn f to complete formation of the previous fringe loop 103. Insertion jet 18 begins its upstream translation in its reciprocation cycle maintaining projection of fringe yarn f downstream downwardly extending primary needle 92 and upstream secondary needle 93.

As the primary needle point 92 extends below the fringe yarn f insertion path primary needle 92 engages previous loop trail fringe yarn 101 downstream primary needle 92, initiating a first stitch loop 112 in the first stitch thread t. Insertion jet 18 continues to project fringe yarn f to complete formation previous fringe loop 103.

Feed dogs 44, pushing work piece 13 downstream, approach the end of their feed stroke, terminating their feed stroke just prior to needle penetration.

Figure 11:
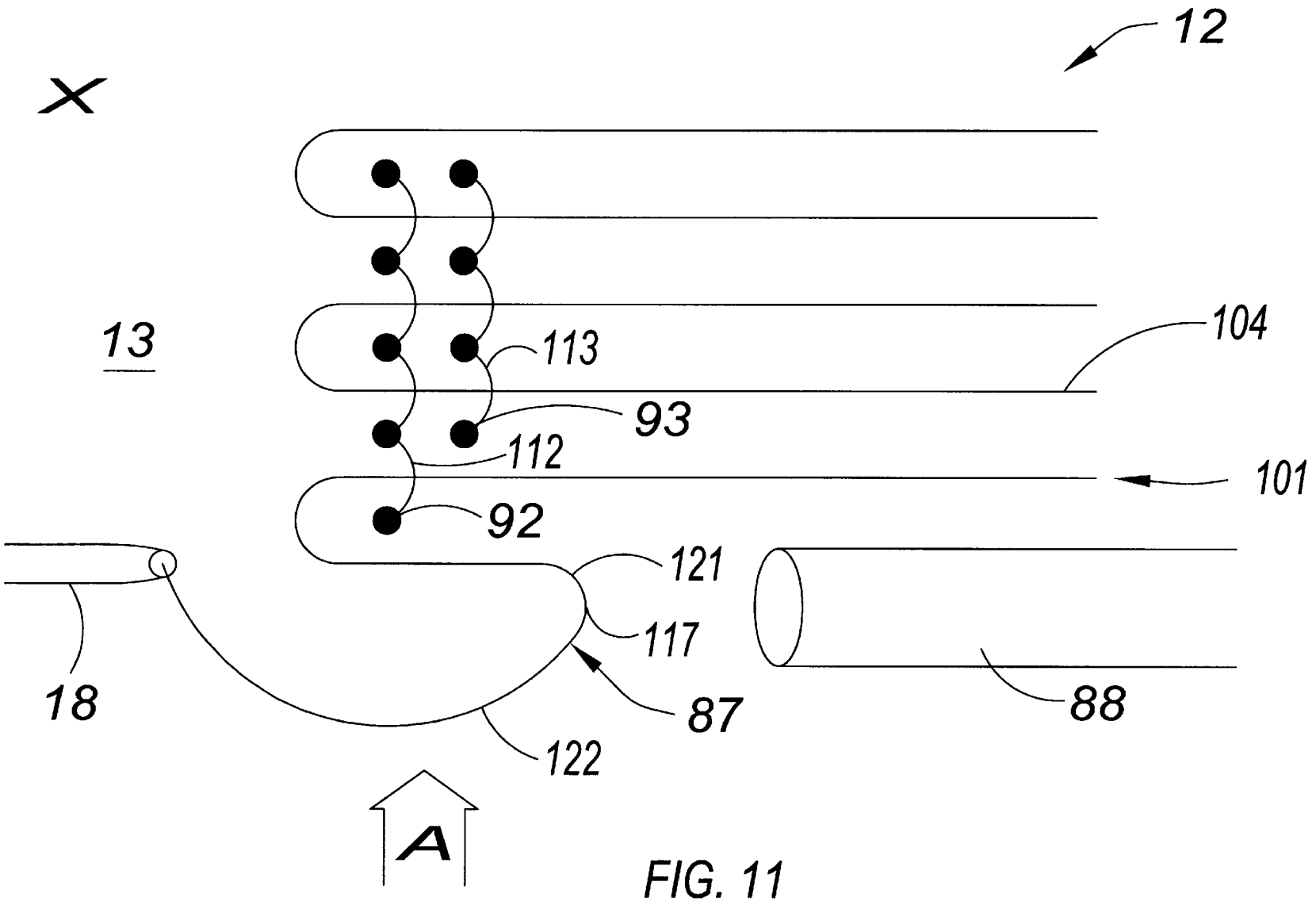
FIG. 11 depicts a schematic drawing of the second step of the fringe sewing cycle.

FIG. 11 depicts the second phase of the fringe sewing cycle. The drawing depicts the cycle with needles 31 having reached their full down position on their first stitch stroke. In the second phase sewing needles 31 begin penetrating work piece 13, at which point primary needle 92 begins applying a first stitch 112 to previous loop trail fringe yarn 101, secondary needle 93 applying a second stitch 113 to previous loop lead fringe yarn 104.

As soon as penetrating needles 31 tension first stitch 112 and second stitch 113 across previous fringe loop lead fringe yarn 104 and trail fringe yarn 101, fringe cutter 21 shears previous fringe loop 103. The shearing operation of the fringe loop cutter 21 is followed shortly thereafter by extractor disc 116 to removes lead fringe yarn 104 and trail fringe yarn 101 from fringe guide channel 88.

Since fringe yarn f engages in first stitch loop 112 in the proceeding phase, insertion jet 18 has translated to the upstream edge of primary needle 92.

Simultaneous with primary needle 92 penetration, fringe yarn f begins forming a new fringe loop 17 in the feed path, fringe yarn f projected by insertion jet 18 and drawn by tensioning channel 88 across the feed path. The controlled fringe yarn feed rate provided by yarn puller 16 regulates fringe loop formation such that fringe yarn extractor 116 has ample time to clear fringe yarn tensioner channel 88 of trimmed fringe yarns 114 and 111 of the previous fringe loop 103.

As soon as the needles 31 are retracted from penetrating work piece 13, feed dogs 44, now repositioned to their upstream position initiate another work piece feed stroke.

Figure 12:
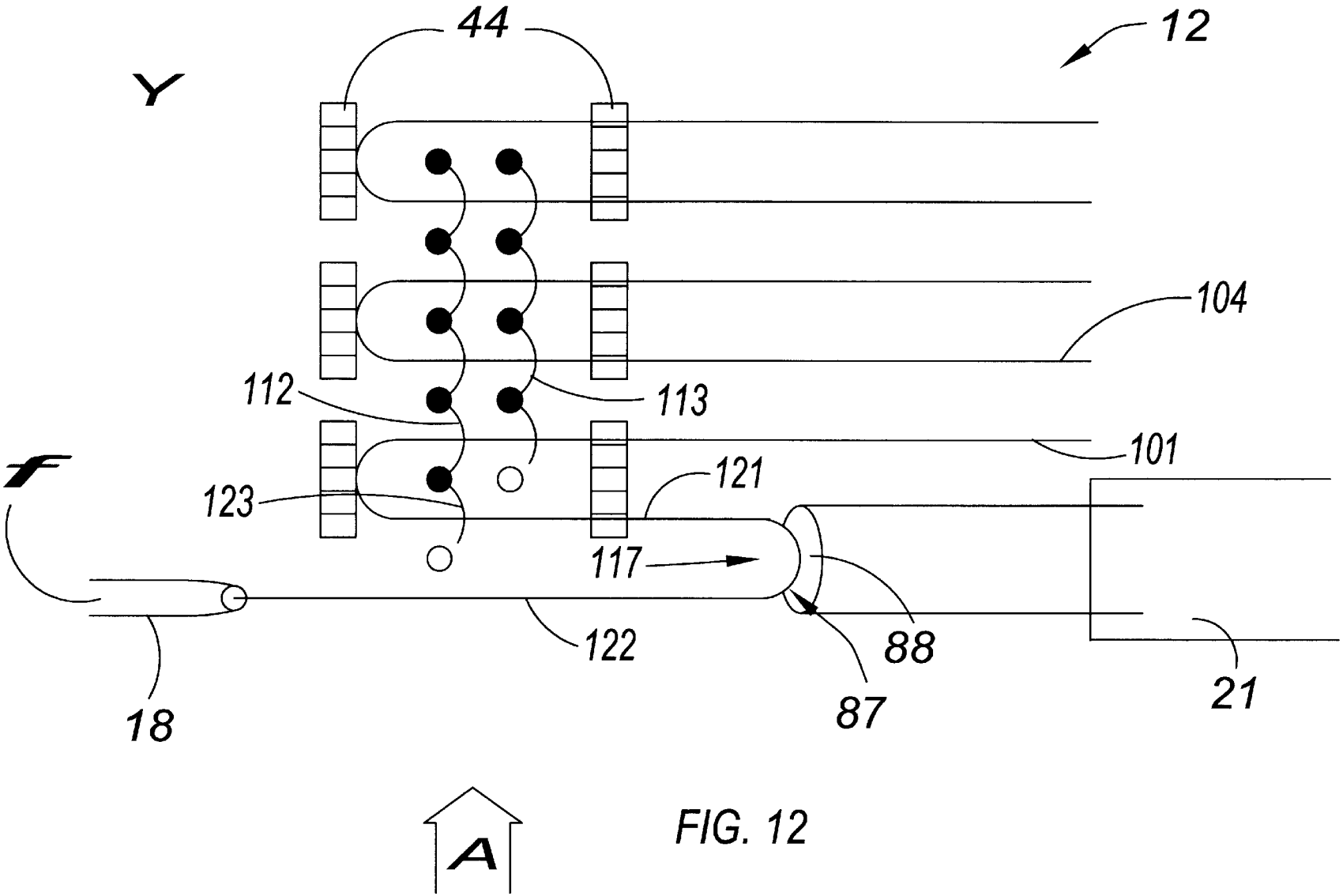
FIG. 12 depicts a schematic drawing of the third step of the fringe sewing cycle.

FIG. 12 depicts the third phase of the fringe sewing cycle. In the drawing the needles have returned to their full up position.

As needles 31 reciprocate upward, feed dogs 44 continue moving work piece 13 downstream. Insertion jet 18 having continued its upstream translation during the needle upstroke reaches its forward limit of travel as needles 31 reach their full up position.

The upstream movement of insertion jet 18 creates a temporary gap between trail fringe yarn and new lead fringe yarn 121 and new trail fringe yarn 122 so that primary needle 92 can apply a new first stitch 123 to secure new lead fringe yarn 121 during the subsequent phase. The forward translation of the insertion jet 18 also enables better propagation of the new fringe loop 117 toward the tensioner channel, new fringe loop 117 reaching fringe tensioner channel 88 as the needles 31 reach their full up positions.

Figure 13:
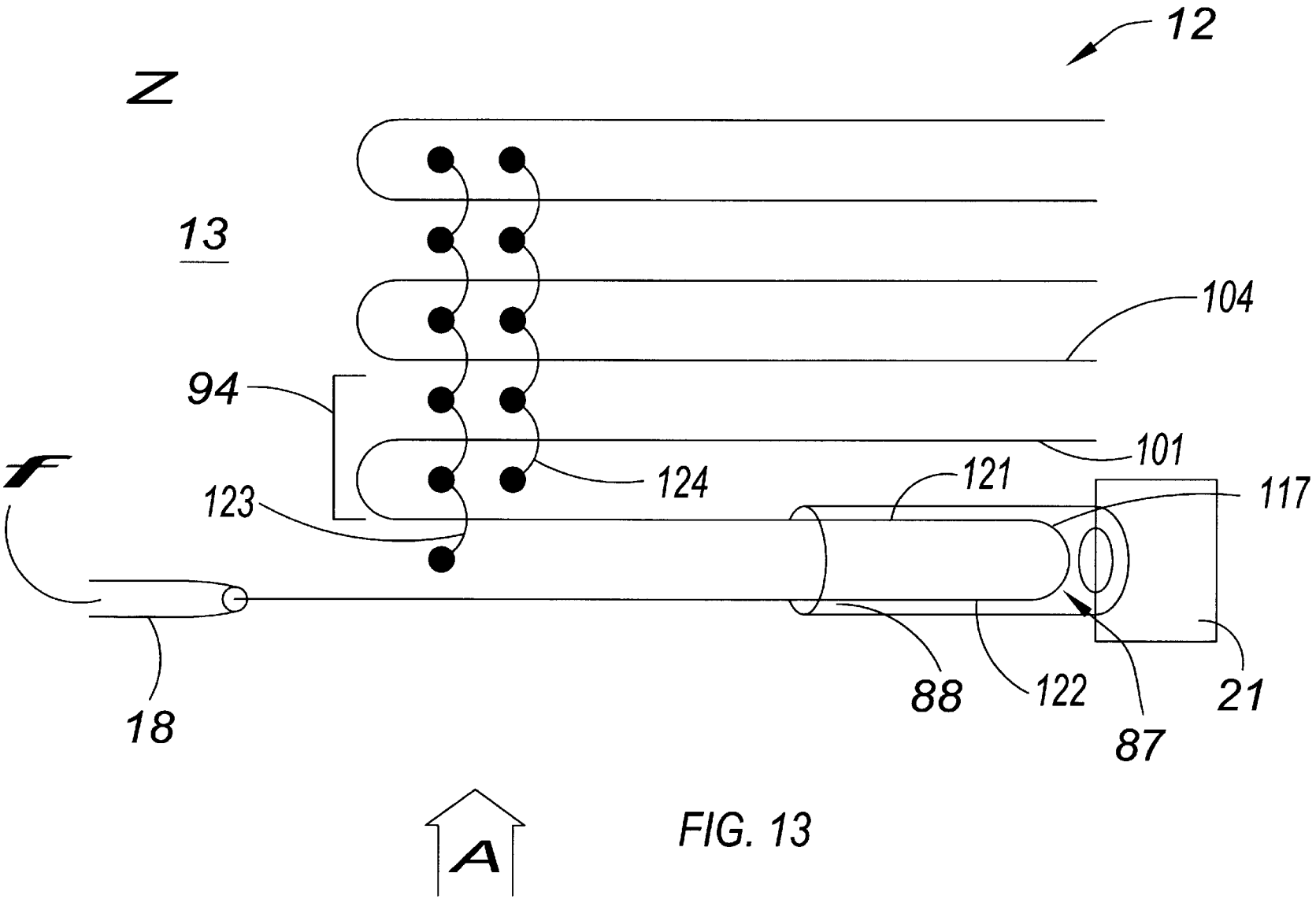
FIG. 13 depicts a schematic drawing of the fourth step of the fringe sewing cycle.

FIG. 13 depicts the final phase of the fringe sewing cycle. The drawing depicts the cycle with needles 31 having reached their full down position on their second stitch stroke of the fringe sewing cycle.

The feed dogs 44 have moved work piece 13 such that lead fringe yarn 121 is tensioned behind primary needle 92. Primary needle 92 makes a first stitch 123 securing lead fringe yarn 121. Secondary needle 93 makes a second stitch 124 on previous trail fringe yarn 101. With second stitch 124 applied to previous fringe trail yarn 101, a complete fringe bead 94 is formed. The insertion jet 18 having begun its downstream movement with the descending sewing needles 31, closes the gap created in the previous phase and begins urging fringe yarn f against primary needle 92, and stitch thread 102 during the upward cycle of needles 31 as the reposition to their upward positions for beginning a new fringe sewing cycle.

The above process is repeated until the desired fringe is obtained on the work piece 13. When the fringe sewing process is completed the work piece 13 is separated from the fringe sewing apparatus 11 by operation of a work piece side cutter 22.

Referring to FIGS. 2, 8, and 9, work piece side cutter 22 is attached distal the fringe sewing apparatus 11. An adapter plate 131 is attached by screws 132 threadingly received within sewing machine 14. A scissors pivot shaft 133 is attached to adapter plate 131 adjacent press foot 56 normal adapter plate 131. An elongated lower blade member 134 is pivotally mounted on pivot shaft 133 at a pivot point 136 on blade member 134. A lower blade cutting extension 137 protrudes downwardly toward the rear of work surface 30. Lower blade cutting extension 137 has an angled tip surface 138. Lower blade member 134 is biased against work surface 30 by a spring 140 operatively attached between a lever extension 139 of lower blade member 134 and an attachment point 141 on adapter plate 131. Lower blade member 134 is biased such that tip surface 138 is urged in mating contact with work surface 30. Angled tip 138 formed such that the tip lower surface is substantially parallel the work surface 30.

Lower blade member movement is synchronized with the operation of the sewing machine press foot 56 such that blade 134 is raised relative work surface 30 when press foot 56 is raised to insert a work piece 13. Lower blade member movement is achieved by an actuator 142, operatively attached between a lower blade member actuator attachment point 143 on adapter plate 131 and an actuator attachment point 144 on a lower blade lever extension 139. After insertion of a work piece 13, the downward bias on lower blade member 134 urges lower blade member 134 against work piece 13 as it is manipulated rearward during fringe sewing cycles by feed dogs 44.

Lower blade cutting extension 137 has a sharpened upper cutting edge 147 for shearing engagement with a sharpened lower edge 148 of an upper blade member 149. Elongated upper blade member 149 is pivotally attached to pivot shaft 133 at an upper blade pivot point 151. Upper blade member 149 attached so that it is extends toward the rear of work surface 30.

A spring 152 on pivot shaft 133 biases upper blade member 149 against an upper blade member stop 153, holding the cutter jaws open to assist manipulation of the finished work piece 13 therein. Spring 152 also biases upper blade member 149 against the lower blade member 134 in mating cooperation. An adjusting screw 154 is threadingly engaged in pivot shaft 133 for adjusting spring 152 tension. Upper blade member 149 is operatively engaged in shearing cooperation across lower blade member 134 by an upper blade actuator 156. Upper blade actuator 156 attached between an upper blade member actuator attachment point 157 distal the upper blade member pivot point 151 and an upper blade actuator attachment point 158 on adapter plate 131.

As work piece 13 is finished, the operator need merely draw the uncut running fringe end 12 into the cutter jaws from the work piece end state position downstream cutter 22. In the present embodiment, upper blade actuator 156 is activated by a remote knee switch (not shown) under work surface 30. Activation of actuator 156 drives upper blade member 149 across lower blade member 134 in sliding shearing contact, severing 13 work piece from the running fringe end 12.

It is to be understood that the form of the invention as shown herein is a preferred embodiment thereof and that various changes and modifications may be made therein without departing from the spirit of the invention or scope as defined in the following claims.

What is claimed is:

1. A thread cutter for a sewing machine, the sewing machine comprising a machine chassis, a sewing head, a working surface, and a pressure foot, said thread cutter comprising:

a. an adapter plate mounted to said machine chassis distal said sewing head;

b. a scissors pivot shaft attached normal to said adapter plate, said scissors pivot shaft positioned on said adapter plate adjacent to said machine pressure foot;

c. an elongated lower blade member comprising a cutting extension, a lever extension, and a pivot point located between said cutting extension and said lever extension, said lower blade member pivotally mounted at said pivot point to said scissors pivot shaft;

d. said cutting extension comprising a sharpened upper cutting edge and an angled tip, said angled tip urged in mating contact with said machine working surface by biasing means;

e. said lever extension comprising a lower blade actuator attachment point;

f. an elongated upper blade member comprising a sharpened lower edge, a pivot point, and an upper blade actuator attachment point, g. said upper blade member pivotally attached to said scissors pivot shaft, h. means for biasing said upper blade member away from said lower blade member, i. upper blade member actuator means connected to said upper blade actuator attachment point and attachment means on said adapter plate, said upper blade actuator means urging said upper blade member in sliding shearing contact across said lower blade member to cut said thread;

j. means for activating said upper blade member actuator to cut said thread, k. lower blade actuator means connected to said lower blade member actuator attachment point and attachment means on said adapter plate, said lower blade actuator synchronized with said machine pressure foot to urge said lower blade member in conformity with said machine pressure foot vertical displacement.

2. The thread cutter of claim 1 further comprising a transparent protective guard, and attachment means for securing said protective guard to said adapter plate and distal to said thread cutter.

3. A fringe cutter for cutting fringe threads along fabric edges said fringe cutter comprising:

a. a rotary blade disc, a fixed blade member mounted proximal said rotary blade disc, rotary drive means for rotating said blade disc, fringe yarn tensioning means for cooperatively elongating said fringe yarn relative to said fixed blade member;

b. fringe waste extractor means for removing cuttings from proximal said fixed blade member; and c. fringe extractor means for removing fringe yarns from said fringe cutter.

4. The fringe cutter of claim 3 further comprising a cutter housing comprising a base block, and an enclosure plate, said base block comprising an outer face, and an inner wall, said outer face having a recessed bore, said bore accepting said rotary blade disc for rotation therein, a vacuum port providing fluid communication between said outer face and said inner wall, said enclosure plate comprises an inner face, an outer face, a drive shaft bore, a vacuum aperture, and a fixed blade insertion slot, said inner face having a mating surface for sealing attachment to said base block, said vacuum aperture providing fluid communication between said inner face and said outer face, said vacuum aperture in substantial alignment with said vacuum port, said rotary blade disc comprising a central hub, a plurality of spoke members extending outwardly from said hub, said spoke members joining said central hub with a disc outer circumferential portion, said hub, spoke members and outer circumferential portion defining a plurality of fringe acceptance chambers, said vacuum port and said enclosure plate vacuum aperture positioned intermediate said hub and said circumferential portion, said spoke members having a sharpened leading edge for urging said fringe threads against said fixed blade, said fixed blade member comprises a sharpened blade edge and an elongated blade extension, said sharpened blade edge mating in sliding shearing contact with said spoke member sharpened blade edges, said elongated blade extension sealingly mounted within said blade insertion slot.

5. A fringe cutter as defined in claim 4 wherein said fringe tensioning means comprises a vacuum source in fluid communication with said vacuum port, said vacuum source drawing fringe yarn loops into said fringe loop acceptance chambers, a fringe guide channel cooperatively attached and extending from said enclosure plate, defining a central bore, said bore in fluid communication with said enclosure plate fringe vacuum aperture, said fringe guide channel having a predetermined length corresponding to a predetermined cut fringe length.

6. A fringe cutter as defined in claim 3 wherein said cut fringe extractor means comprises a disc, a central hub, a plurality of spoke members extending outwardly from said hub, said spoke members joining said central hub with an extractor disc outer annular rim, said hub area, spoke members and outer annular rim defining a plurality of fringe extractor chambers, said central hub comprises a central bore to accept said drive shaft and means for attaching said fringe extractor to said drive shaft for rotation therewith, said drive shaft and said spoke members urging said cut fringe yarns from said fringe guide channel.

* * * * *